US011357300B2

(12) United States Patent
Hashish

(10) Patent No.: US 11,357,300 B2
(45) Date of Patent: Jun. 14, 2022

(54) SYSTEM AND METHOD OF EXPANDABLE CONTAINERS

(71) Applicant: Rami Hashish, Los Angeles, CA (US)

(72) Inventor: Rami Hashish, Los Angeles, CA (US)

( * ) Notice: Subject to any disclaimer, the term of this patent is extended or adjusted under 35 U.S.C. 154(b) by 650 days.

(21) Appl. No.: 16/040,464

(22) Filed: Jul. 19, 2018

(65) Prior Publication Data

US 2020/0022473 A1 Jan. 23, 2020

(51) Int. Cl.

| | |
|---|---|
| ***A45C 7/00*** | (2006.01) |
| ***A45C 5/03*** | (2006.01) |
| ***A45C 5/14*** | (2006.01) |

(52) U.S. Cl.

CPC ..... *A45C 7/0022* (2013.01); *A45C 5/03* (2013.01); *A45C 5/14* (2013.01); *A45C 2005/037* (2013.01)

(58) Field of Classification Search

CPC ..... A45C 7/0022; A45C 5/03; A45C 5/14; A45C 5/037

See application file for complete search history.

(56) References Cited

U.S. PATENT DOCUMENTS

| | | | | | |
|---|---|---|---|---|---|
| 1,152,987 | A * | 9/1915 | Spalding | A47B 3/02 | 108/118 |
| 2,967,716 | A * | 1/1961 | Murcott | D06F 1/00 | 280/641 |
| 5,115,895 | A * | 5/1992 | Myers | A45C 5/14 | 190/123 |
| 5,281,019 | A * | 1/1994 | Rodeck | A47B 97/02 | 190/11 |
| D371,023 | S * | 6/1996 | Higgins | A45C 5/14 | D6/678.4 |
| 5,671,831 | A * | 9/1997 | Chiu | A45C 5/14 | 190/103 |
| 7,828,377 | B2 * | 11/2010 | Grace | A47C 4/283 | 297/42 |
| 7,874,409 | B1 * | 1/2011 | Lakhal | A45C 7/00 | 190/105 |
| 8,292,239 | B1 * | 10/2012 | Elden Limb | B65B 67/1205 | 248/97 |
| 8,667,907 | B2 * | 3/2014 | Grace | A47B 3/02 | 108/116 |
| 2008/0012399 | A1 * | 1/2008 | Lin | A47C 4/283 | 297/188.08 |
| 2018/0310679 | A1 * | 11/2018 | Maslawi | A45C 7/0036 | |

* cited by examiner

*Primary Examiner* — Tri M Mai

(74) *Attorney, Agent, or Firm* — Cohen IP Law Group, PC; Michael N. Cohen

(57) ABSTRACT

An expandable container is disclosed. The expandable container may include a frame with extendable sections, an expandable material covering the frame and protective plates secured to the expandable material.

14 Claims, 11 Drawing Sheets

SYSTEM AND METHOD OF EXPANDABLE CONTAINERS

COPYRIGHT STATEMENT

This patent document contains material subject to copyright protection. The copyright owner has no objection to the reproduction of this patent document or any related materials in the files of the United States Patent and Trademark Office, but otherwise reserves all copyrights whatsoever.

FIELD OF THE INVENTION

This invention relates to containers. More particularly, this invention relates to expandable containers such as expandable carrying cases.

BACKGROUND

It is well known that different sized containers may be used for different volumes of items or different types of items to be stored.

In one example, it is well known that different sizes of luggage may be used for different occasions. For instance, a smaller sized piece of luggage may be used to take on an overnight trip when only a limited number of items may be need to be carried in the container. Alternatively, a larger piece of luggage may be required for a longer trip that may require a larger number of items to be carried.

This may result in the need for a person to purchase and own several different pieces of luggage of varying sizes. It is not uncommon for a person to own at least three sizes of luggage, such as a small "personal" sized piece of luggage, a medium sized "carry-on piece of luggage, and a large check-in piece of luggage. However, this may be costly due to the fact that three different pieces of luggage are required to be purchased and owned. The multiple pieces of luggage may also take up a lot of space in the person's home.

Some luggage may be available that may expand in volume, but the luggage may only expand in one dimension and by a very limited amount. Other luggage may expand but lose mechanical and/or structural integrity upon expansion.

Accordingly, there is a need for a container that may expand in volume in more than one dimension. There is also a need for a container to expand in more than one dimension while maintaining its mechanical and structural integrity.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein:

FIG. 2 shows aspects of an expandable container according to exemplary embodiments hereof;

DETAILED DESCRIPTION OF THE PRESENTLY PREFERRED EXEMPLARY EMBODIMENTS

Figure 1:
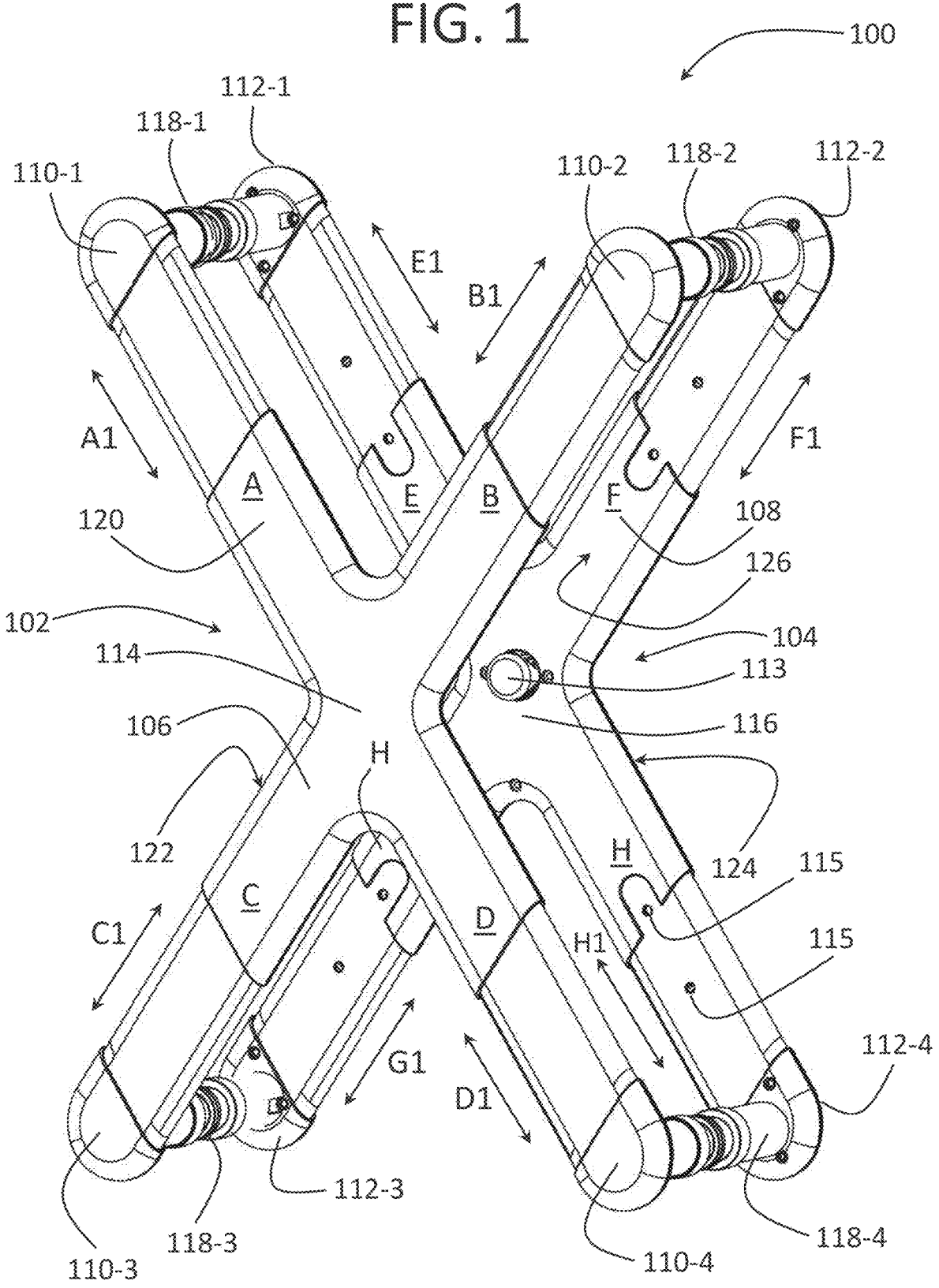
FIGS. 1-3 show aspects of an expandable container according to exemplary embodiments hereof.

The term "mechanism," as used herein, refers to any device(s), process(es), service(s), or combination thereof. A mechanism may be implemented in hardware, software, firmware, using a special-purpose device, or any combination thereof. A mechanism may be mechanical or electrical or a combination thereof. A mechanism may be integrated into a single device or it may be distributed over multiple devices. The various components of a mechanism may be co-located or distributed. The mechanism may be formed from other mechanisms. In general, as used herein, the term "mechanism" may thus be considered shorthand for the term device(s) and/or process(es) and/or service(s).

In general, the assembly 10 according to exemplary embodiments hereof provides an expandable container 12. The frame and/or shell of the container 12 may be simultaneously expanded in one, two and three dimensions, to effectively increase the internal volume of the container 12. The assembly 10 may be implemented as luggage, carrying cases, baggage, suitcases, briefcases, shipping containers, storage containers and other types of containers and/or cases. It is understood that the scope of the assembly 10 is not limited in any way by the scope by its implementation.

In one exemplary embodiment hereof, the assembly 10 may include a frame assembly 100, a shell assembly 200, a protective assembly 300 and a variety of other components and elements as required for the assembly 10 to fulfill its various functionalities as will be described in later sections. The frame assembly 100 may be generally rigid with expandable elements, and the shell assembly 200 may generally cover the frame assembly 100 to generally define an inner volume within. The protective assembly 300 may provide protection and reinforcement to the container 12 before, during and after the frame assembly 100 and the shell assembly 200 may expand. In this way, the mechanical integrity of the container 12 may be maintained as the volume of the container 12 is increased through the expansion of the frame assembly 100 and the shell assembly 200.

The various assemblies, components and elements of the assembly 10 will now be described in detail with reference to FIGS. 1-3, 4A-4B, 5-6, 7A-7C and 8.

The Frame Assembly

Referring now to FIGS. 1, 2, 3, 4A, 4B and 5, the frame assembly 100 according to exemplary embodiments hereof will be described in further detail. The frame assembly 100 may include any form, shape or dimension that may allow for at least a portion of the frame assembly 100 to expand in at least one dimension. It may be preferred that the frame assembly may expand in two or three dimensions.

In a preferred exemplary embodiment as shown in FIG. 1, the frame assembly 100 may include a front frame section 102 and a rear frame section 104. However, the frame assembly may include only the front frame section 102 or only the rear frame section 104 as required. In a preferred implementation, the front frame section 102 may include a front cross support 106 that may generally be cross-shaped, and the rear frame section 104 may include a rear cross support 108 that may also be generally cross-shaped. The front cross support 106 may include a base 114 that may generally form the center section of the cross support 106, and arm sections A, B, C and D that may generally extend radially outward from the base 114. In this way, the arm sections A, B, C and D extending outward from the base 114 may generally form the cross shaped front cross support 106.

Figure 2:
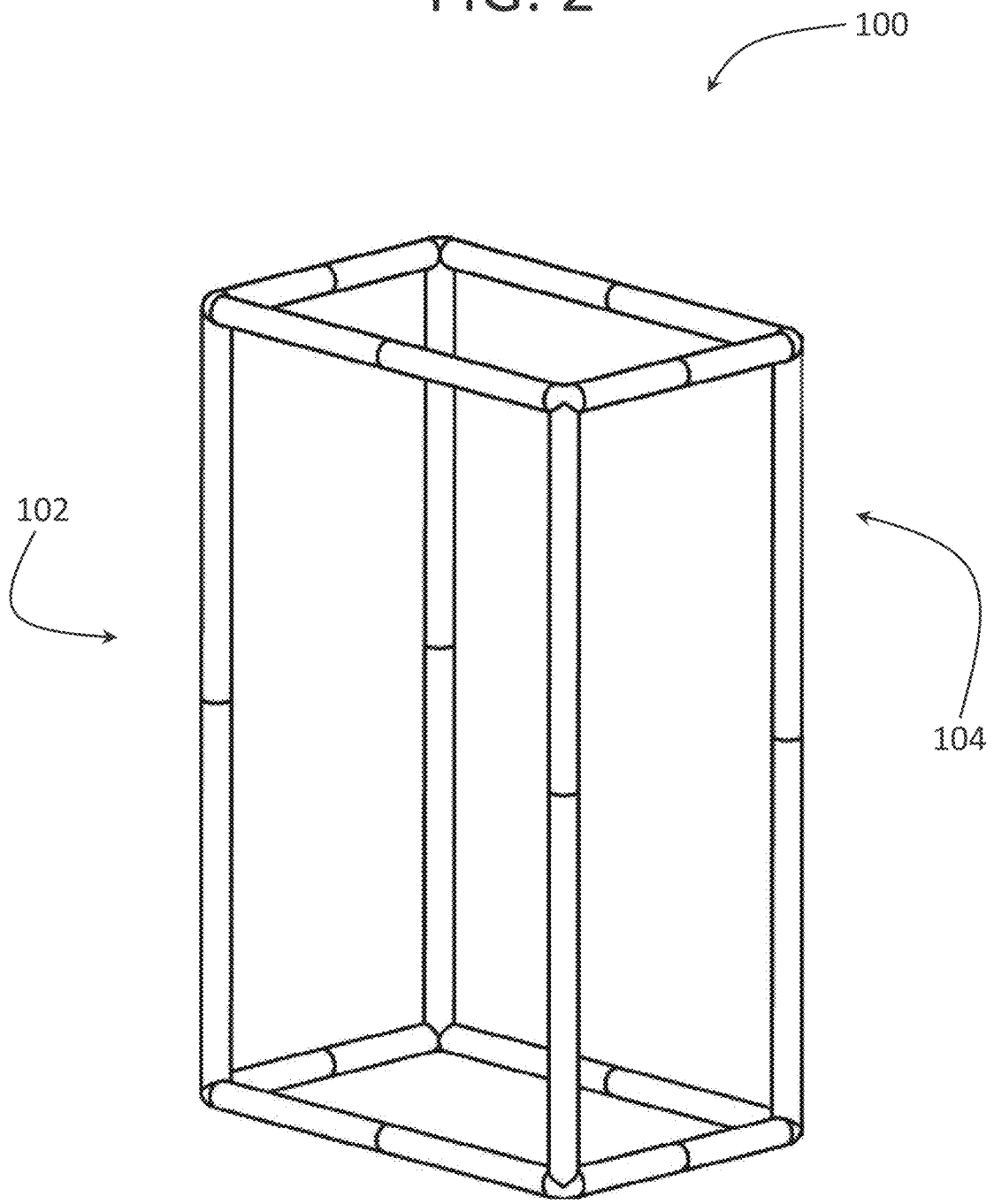

It is clear that other shapes and forms of frame assembly 100 are also contemplated in this specification and that the frame assembly 100 may be of any shape and form that may allow it to perform its functionalities. For example, the frame assembly 100-1 may be generally rectangular with rectangular front and rear frame sections 102-1, 104-1 as shown in FIG. 2. Other shapes and forms that may allow for at least a portion of the frame assembly 100 to expand in at least one dimension may be used and it is understood that the shape and form of the frame assembly 100 does not limit the scope of the frame assembly or the assembly 10 in any way.

Returning to FIG. 1, the rear cross support 108 may include a base 116 that may generally form the center section of the cross support 108, and arm sections E, F, G and H that may generally extend radially outward from the base 116. In this way, the arm sections E, F, G and H extending outward from the base 116 may generally form the cross shaped rear cross support 108.

According to exemplary embodiments hereof, one or more of the arm sections A-D, E-H may each have the ability to expand in length, and subsequently contract in length, along its radial axis.

To facilitate the expansion and retraction of each arm section, each arm section A-D of the front frame structure 102 may include one or more extension sections 110-1, 110-2, . . . **110-*n* (individually and collectively 110), where n may equal the number of arm sections. For example, expandable arm section A may include extension section 110-1, expandable arm section B may include extension section 110-2, expandable arm section C may include extension section 110-3, and expandable arm section D may include extension section 110-4**.

In addition, each arm section E-H of the rear frame structure 104 may include one or more extension sections 112-1, 112-2, . . . **112-*n* (individually and collectively 112), where n may equal the number of arm sections. For example, expandable arm section E may include extension section 112-1, expandable arm section F may include extension section 112-2, expandable arm section G may include extension section 112-3, and expandable arm section H may include extension section 112-4**.

Each extension section 110, 112 may generally telescopically (or otherwise) extend from and retract into its respective arm section A-D and E-H respectively. For example, extension section 110-1 may extend from and retract into arm section A in the direction denoted by the arrow A1, extension section 110-2 may extend from and retract into arm section B in the direction denoted by the arrow B1, extension section 110-3 may extend from and retract into arm section C in the direction denoted by the arrow C1, and extension section 110-4 may extend from and retract into arm section D in the direction denoted by the arrow D1. In addition, extension section 112-1 may extend from and retract into arm section E in the direction denoted by the arrow E1, extension section 112-2 may extend from and retract into arm section F in the direction denoted by the arrow F1, extension section 112-3 may extend from and retract into arm section G in the direction denoted by the arrow C1, and extension section 112-4 may extend from and retract into arm section H in the direction denoted by the arrow H1. In this way, the arm sections A-H may be expandable arm sections. Note that the extension sections 110, 112 may not necessarily extend from and retract into each corresponding arm A-D, E-H, but may extend and retract in side-by-side configurations with each corresponding arm A-D, E-H, or in any other configuration and/or orientation with each corresponding arm A-D, E-H that may allow the extension sections 110, 112 to adequately extend and retract according to the embodiments hereof.

Each frame structure 102, 104 may include at least one extension control mechanism 113 (such as a button or other type of control mechanism) that may release the extension sections 110, 112 from retracted positions to be extended, from extended positions to be further extended and from extended positions to be retracted. The arms A-D, E-H may include locking mechanisms 115 that may include spring loaded pins and receiving holes (or other types of locking mechanisms) that may lock the extension sections 110, 112 in retracted positions, in partially extended positions and in fully extended positions. In addition, the extension sections 110, 112 may be spring loaded so that the sections 110, 112 may automatically expand and/or retract upon the activation of the control mechanism 113 and/or the locking mechanisms 115.

It may be preferable that the front frame section 102 (including front cross support 106, arm sections A-D and arm extensions 110-1-110-4) and the rear frame section 104 (including front cross support 108, arm sections E-H and arm extensions 112-1-112-4) be of the same or similar form, shape and dimensions, and for the frame sections 102, 104 to generally mirror each other when configured as shown. However, this may not be necessary, and the front frame section 102 and the rear frame section 104 may have different forms as required.

The front frame section 102 may include a front surface 120 and a back surface 122, and the rear frame section 104 may include a front surface 124 and a rear surface 126. The front frame section 102 may be configured with the rear frame section 104 by positioning the front frame section 102 in front of the rear frame section 104 with the back surface 122 of the front frame section 102 facing the back surface 126 of the rear frame section 104. In this way, the front surface 120 of the front frame section 102 and the front surface 124 of the rear frame section 104 may generally face in opposing directions. The front frame section 102 and the rear frame section 104 may be aligned along an axis passing through the center of the base 114 of the front cross support 106 and the center of the base 116 of the rear cross support 108. The arm sections A-D may also be aligned with the arm sections E-H such that the corresponding components of the front and rear frame sections 102, 104 may all be generally aligned. This is shown in FIG. 1.

In this aligned configuration, and according to exemplary embodiments hereof, the front frame section 102 may be connected to the rear frame section 104 by connecting sections 118. The connecting section 118-1 may generally extend from the back surface 122 of the upper region of the arm extension 110-1 to the back surface 126 of the upper region of the arm extension 112-1. Similarly, the connecting section 118-2 may generally extend from the back surface 122 of the upper region of the arm extension 110-2 to the back surface 126 of the upper region of the arm extension 112-2, the connecting section 118-3 may generally extend from the back surface 122 of the upper region of the arm extension 110-3 to the back surface 126 of the upper region of the arm extension 112-3, and the connecting section 118-4 may generally extend from the back surface 122 of the upper region of the arm extension 110-4 to the back surface 126 of the upper region of the arm extension 112-4.

It may be preferable that the connecting sections 118-1, 118-2, 118-3 and 118-4 (collectively and individually 118) have the ability to expand in length and to subsequently contract in length. For example, the connecting sections 118 may include telescoping sections that may allow the sections 118 to expand and retract as necessary. This may allow the distance between the back surface 122 of the front frame section 102 and the back surface 126 of the rear frame section 104 to be varied (e.g., increased or decreased).

Figure 3:
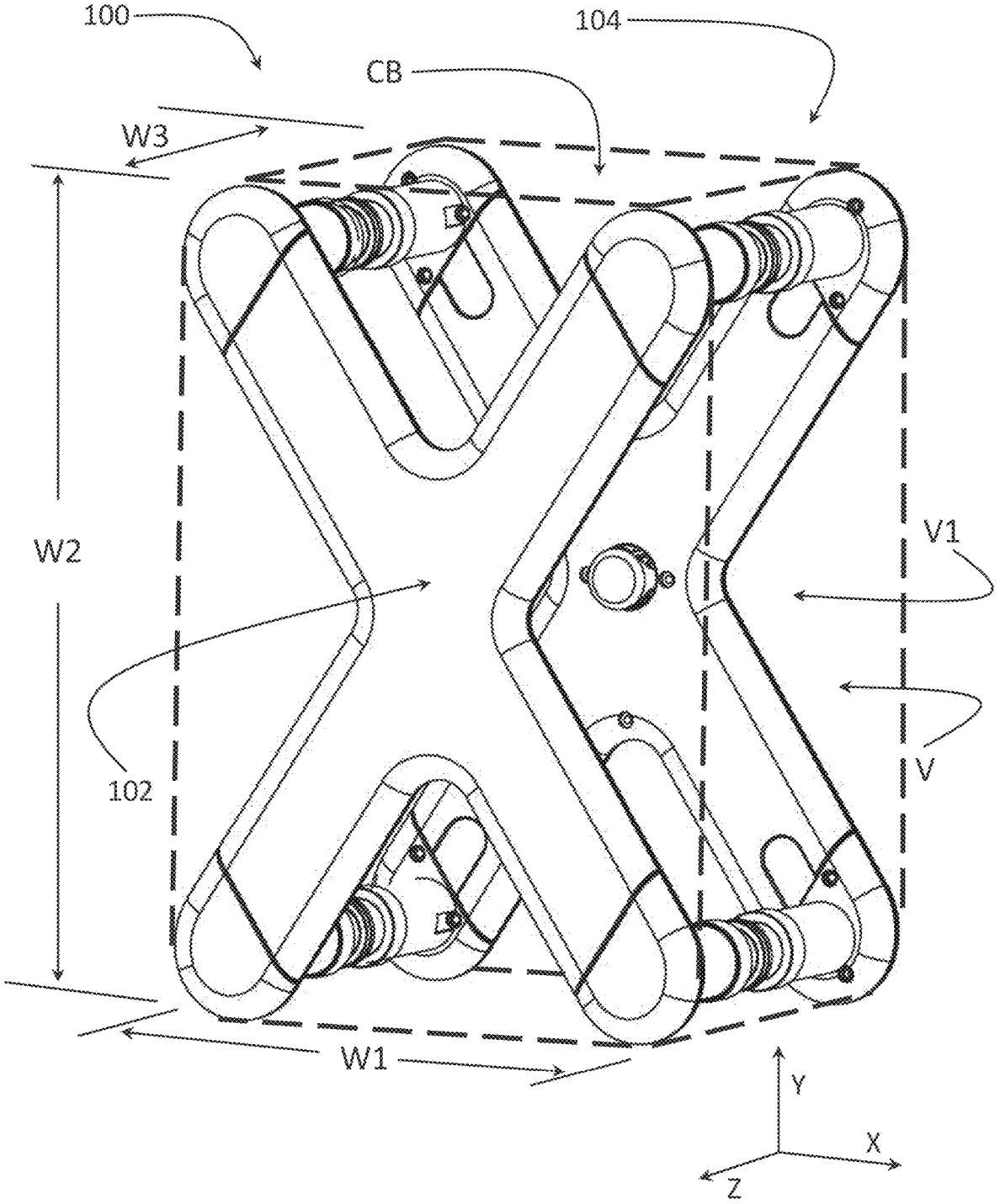

It can be seen that with the front frame section 102 configured with the rear frame section 104 and the connecting sections 118 as described, that an internal volume V may be formed between the sections 102, 104. As shown in FIG. 3, in one embodiment the internal volume V may be represented as a three dimensional form such as a cuboid CB (note that other shapes or forms may also be formed). The volume V may have a width (e.g., along the x-axis) generally equal to the width W1 of the combined frame sections 102, 104, a height (e.g., along the y-axis) generally equal to the height W2 of the combined frame sections 102, 104, and a depth (e.g., along the z-axis) generally equal to the separation W3 between the combined frame sections 102, 104. In this way, the internal volume V of the cuboid may be represented as:

$$V=W1\times W2\times W3$$

For the purposes of this specification, the volume V1 will be defined as the volume formed between the frame structures 102, 104 when the extension sections 110 are each fully retracted within their respective extendable arms A-D, the extension sections 112 are each fully retracted within their respective extendable arms E-H, and the connecting sections 118 are fully retracted such that the separation between the frames 102, 104 is set to a minimum setting. This may result in:

$$W1=W1-1$$

$$W2=W2-1$$

$$W3=W3-1$$

Given this, the internal volume V1 may be represented as:

$$V1=W1-1\times W2-1\times W3-1$$

It can be appreciated that with the components of the frames 102, 104 each configured as described, that W1-1 may be a minimum W1, that W2-1 may be a minimum W2, and that W3-1 may be a minimum W3. In addition, the volume V1 may be a minimum volume formed between the frame structures 102, 104.

To increase the internal volume V between the frame structures 102, 104 (e.g., the volume V1 of the cuboid CB as described above), the extension sections 110, 112 may be extended from their respective arms A-D, E-H respectively as described above, and the connecting sections 118 may be extended to increase the separation between the frames 102, 104.

Figure 4A:
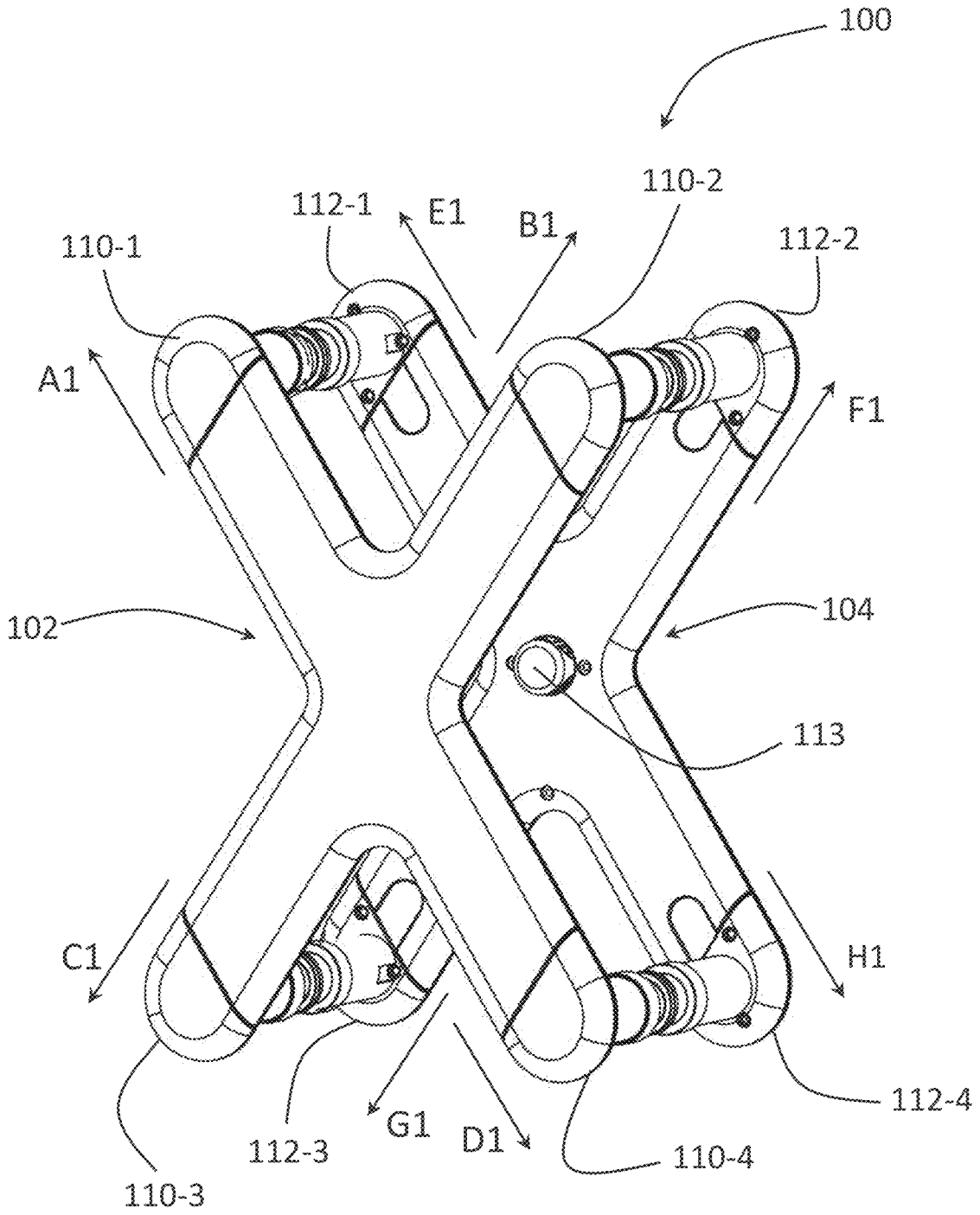
FIGS. 4A-4B show aspects of an expandable container according to exemplary embodiments hereof.
Figure 4B:
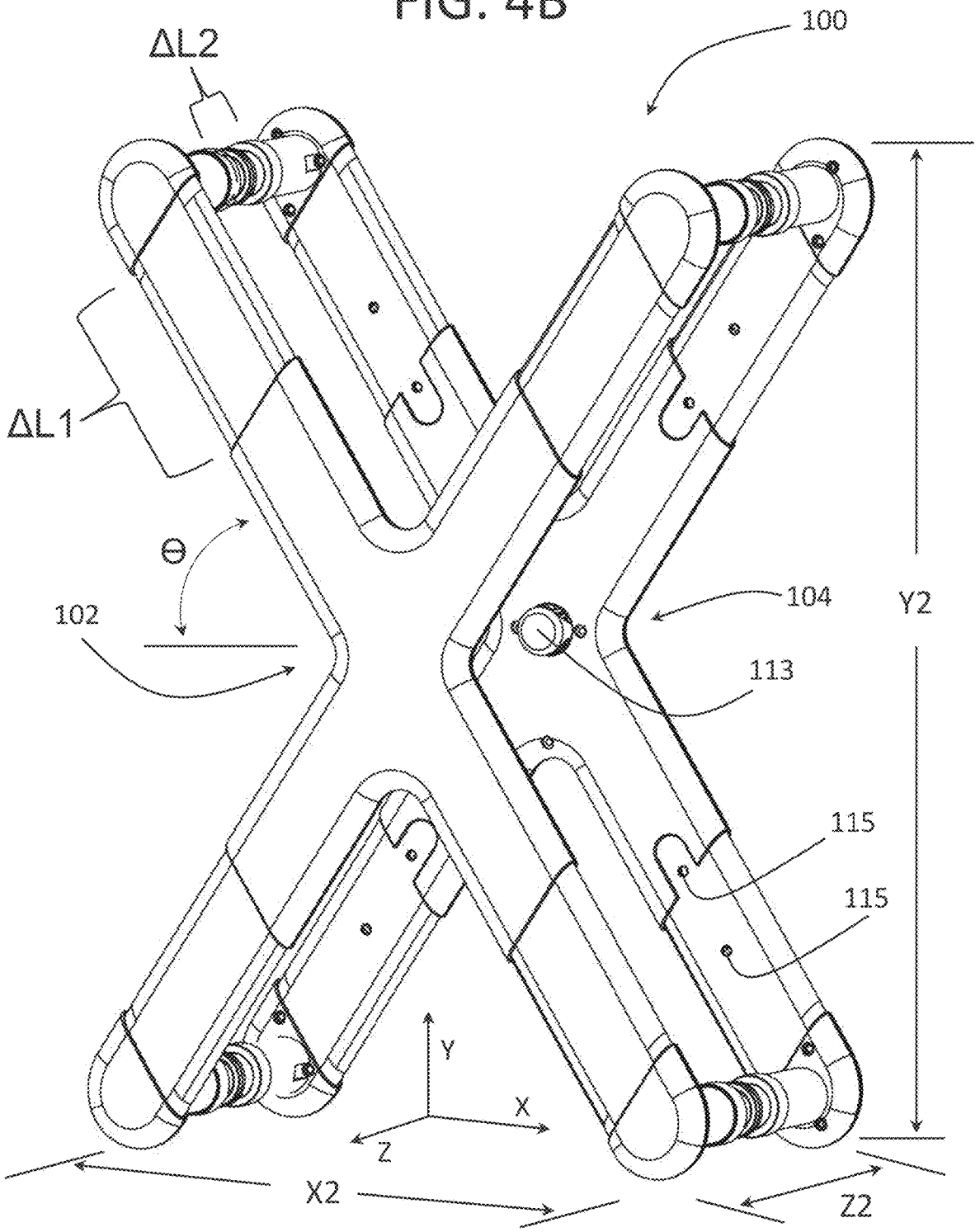

For example, referencing FIGS. 4A and 4B, as the extension section 110-1 may extend from a retracted position (FIG. 4A) to an extended position (FIG. 4B) in the direction denoted by the arrow A1, as the extension section 110-2 may extend from a retracted position to an extended position in the direction denoted by the arrow B1, as the extension section 112-1 may extend from a retracted position to an extended position in the direction denoted by the arrow E1, and as the extension section 112-2 may extend from a retracted position to an extended position in the direction denoted by the arrow F1, the width of the frame sections 102, 104 may increase from X1 to X2, and the height of the frame sections 102, 104 may increase from Y1 to Y2.

In one example as depicted in FIG. 4B, the extension sections 110, 112 may each be extended from their fully retracted positions (shown in FIG. 4A) by an amount of ΔL1 (shown in FIG. 4B). Vectorially speaking, this extension may include a vertical extension component ΔY1 and a horizontal extension component ΔX1. Note that the angle ⊖ may represent the angle between the horizontal axis and the arms A-D, E-H as shown.

In addition, the connecting sections 118 may be each extended from their fully retracted positions (shown in FIG. 4A) by an amount of ΔL2

As shown in FIG. 4B, these extensions may result in:

$$W1=W1-1+\Delta X1=W1-2$$

$$W2=W2-2+\Delta Y1=W2-2$$

$$W3=W3-2+\Delta 2=W3-2$$

Given this, the extended volume V2 may be represented as:

$$V2=W1-2\times W2-2\times W3-2$$

As known in the art, these extension components may be related and represented as:

$$\text{Sin}\oplus=\Delta Y1/\Delta L1$$

$$\text{Cos}\oplus=\Delta X1/\Delta L1$$

$$\text{Tan}\oplus=\text{Sin}\oplus/\text{Cos}\oplus$$

In one example, the values associated with FIG. 4A may be:

$$W1-1=10\text{ inches}$$

$$W2-1=15\text{ inches}$$

$$W3-1=9\text{ inches}$$

This leads to:

$$V1=10\times 15\times 9=1350\text{ cubic inches}$$

In one example, using ΔL1=6.0 inches, ΔL2=1.5 inches and setting ⊕=60°, solving the above equations for ΔY1 and ΔX1 yields:

$$\Delta Y1=5.2\text{ inches}$$

$$\Delta X1=3.0\text{ inches}$$

This may result in a V2 as:

$$V2=(W1-1+\Delta X1)\times(W2-1+\Delta Y1)\times(W3-1+\Delta L2)$$

$$V2=13\times 20.2\times 10.5=2757.3\text{ cubic inches.}$$

This may represent an increase of internal volume ΔV=1407.3 cubic inches and an increase in internal volume of over 104%.

It is understood by a person of skill in the art, upon reading this specification, that the amounts of extension described above are meant for demonstration and conceptual purposes, and that any other amounts of expansion may also be used and are contemplated in this disclosure. In addition, during implementation, the amounts of expansion for each extension section 118 may all be the same, may all differ, or may expand in any amount relative to one another, or in any combination thereof. It is also understood that the specific amounts of expansion do not in any way limit the scope of the assembly 10. It is also understood that the arms A-D, E-H may be at any angle with respect to one another (e.g., e), that the angles do not need to match, and that the angles do not limit the scope of the assembly 10 in any way.

In one exemplary implementation hereof, the assembly 10 may be adjustable to three primary sizes as shown in the table below. It is clear that the assembly 10 may be adjusted to other sizes and that the specific size that the assembly is adjusted to does not limit the scope of the assembly 10 in any way.

| | Small | Medium | Large |
|---|---|---|---|
| W1 (in) | 10.58 | 14.00 | 18.45 |
| W2 (in) | 16.60 | 22.00 | 29 |
| W3 (in) | 9.00 | 9.00 | 12.5 |
| Volume (cubic inches) | 1580.65 | 2772.00 | 6688.13 |

Figure 5:
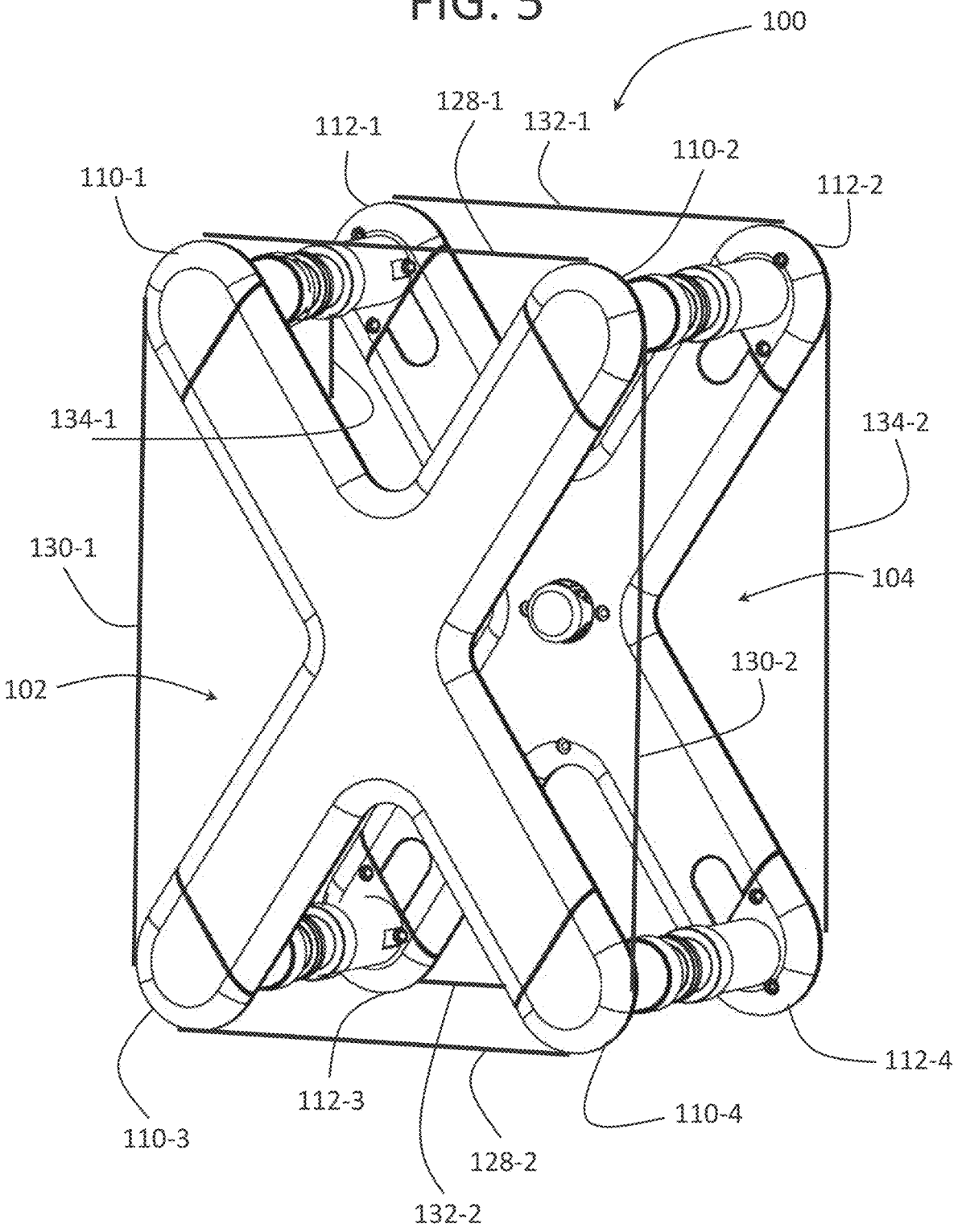
FIGS. 5-6 shows aspects of an expandable container according to exemplary embodiments hereof.

Moving on, in one exemplary embodiment hereof, the frame sections 102, 104 may include additional reinforcement structures. For example, and as shown in FIG. 5, the frame structure 102-2 may include an upper reinforcement structure 128-1 and a lower reinforcement structure 128-2. As shown, the upper reinforcement structure 128-1 may extend laterally between the area of the junction of the arm extension 110-1 and the connecting structure 118-1 on the upper left, to the area of the junction of the arm extension 110-2 and the connecting structure 118-2 on the upper right. In this way, the reinforcement structure 128-1 may provide lateral support generally across the top of the frame structure 102-2. The lower reinforcement structure 128-2 may extend laterally between the area of the junction of the arm extension 110-3 and the connecting structure 118-3 on the lower left, to the area of the junction of the arm extension 110-4 and the connecting structure 118-4 on the lower right. In this way, the reinforcement structure 128-2 may provide lateral support generally across the bottom of the frame structure 102-2.

The frame structure 102-2 may also include a left reinforcement structure 130-1 and a right reinforcement structure 130-2. As shown, the left reinforcement structure 130-1 may extend laterally between the area of the junction of the arm extension 110-1 and the connecting structure 118-1 on the upper left, to the area of the junction of the arm extension 110-3 and the connecting structure 118-3 on the lower left. In this way, the reinforcement structure 130-1 may provide vertical support generally to the left side of the frame structure 102-2. The right reinforcement structure 130-2 may extend vertically between the area of the junction of the arm extension 110-2 and the connecting structure 118-2 on the upper right, to the area of the junction of the arm extension 110-4 and the connecting structure 118-4 on the lower right. In this way, the reinforcement structure 130-2 may provide vertical support generally to the right side of the frame structure 102-2.

Similarly, the frame structure 104-2 may include an upper reinforcement structure 132-1 and a lower reinforcement structure 132-2. As shown, the upper reinforcement structure 132-1 may extend laterally between the area of the junction of the arm extension 112-1 and the connecting structure 118-1 on the upper left, to the area of the junction of the arm extension 112-2 and the connecting structure 118-2 on the upper right. In this way, the reinforcement structure 132-1 may provide lateral support generally across the top of the frame structure 104-2. The lower reinforcement structure 132-2 may extend laterally between the area of the junction of the arm extension 112-3 and the connecting structure 118-3 on the lower left, to the area of the junction of the arm extension 112-4 and the connecting structure 118-4 on the lower right. In this way, the reinforcement structure 132-2 may provide lateral support generally across the bottom of the frame structure 104-2.

The frame structure 104-2 may also include a left reinforcement structure 134-1 and a right reinforcement structure 134-2. As shown, the left reinforcement structure 134-1 may extend laterally between the area of the junction of the arm extension 112-1 and the connecting structure 118-1 on the upper left, to the area of the junction of the arm extension 112-3 and the connecting structure 118-3 on the lower left. In this way, the reinforcement structure 134-1 may provide vertical support generally to the left side of the frame structure 104-2. The right reinforcement structure 134-2 may extend vertically between the area of the junction of the arm extension 112-2 and the connecting structure 118-2 on the upper right, to the area of the junction of the arm extension 112-4 and the connecting structure 118-4 on the lower right. In this way, the reinforcement structure 134-2 may provide vertical support generally to the right side of the frame structure 104-2.

Note that the reinforcement structures 128-1, 128-2, 130-1, 130-2, 132-1, 132-2, 134-1, 134-2 may have the ability to expand and contract in length (e.g., telescopically or by other means), such that as the extendable arms A-D, E-H may extend and contract by the extension and retraction of the extension sections 110, 112 respectively, the reinforcement structures 128-1, 128-2, 130-1, 130-2, 132-1, 132-2, 134-1, 134-2 may also expand and contract accordingly. In this way, each component may extend and contract in unison as described, resulting in the expansion and contraction of the internal volume V.

It is understood by a person of ordinary skill in the art that the frame structures (e.g., the front and rear cross supports 106, 108) may include any number of arms, and that while the description above describes the front cross support 106 and the rear cross support 108 as including four arms each A-D, E-H, the front cross support 106 and the rear cross support 108 may include any number of arms. For example, the front cross support 106 and the rear cross support 108 may each include six arms, eight arms or other numbers of arms. In addition, the front cross support 106 and the rear cross support 108 may include different number of arms compared with one another, and the number of arms need not match.

The frame structures 102, 104, the extension structures 110, 112, the connecting structures 118, the reinforcement structures 128, 130, 132, 134, and any other structures or components that may be used in relation with the frame assembly 100 may comprise metal (e.g., aluminum, steel, or other kinds of metal), plastic (e.g., Polycarbonate, ABS, or other types of plastics), composite materials, or any other types or combinations of types of materials as required.

In addition, while the descriptions above generally describe the extension of the various components and structures being facilitated by telescopic expansion and retraction, other methods of expansion may be used such as side-by-side sliding expansion, expansion within rails or other guidance mechanisms, or any other types or combination of types of expansion methods or mechanisms.

The Shell Assembly

Figure 6:
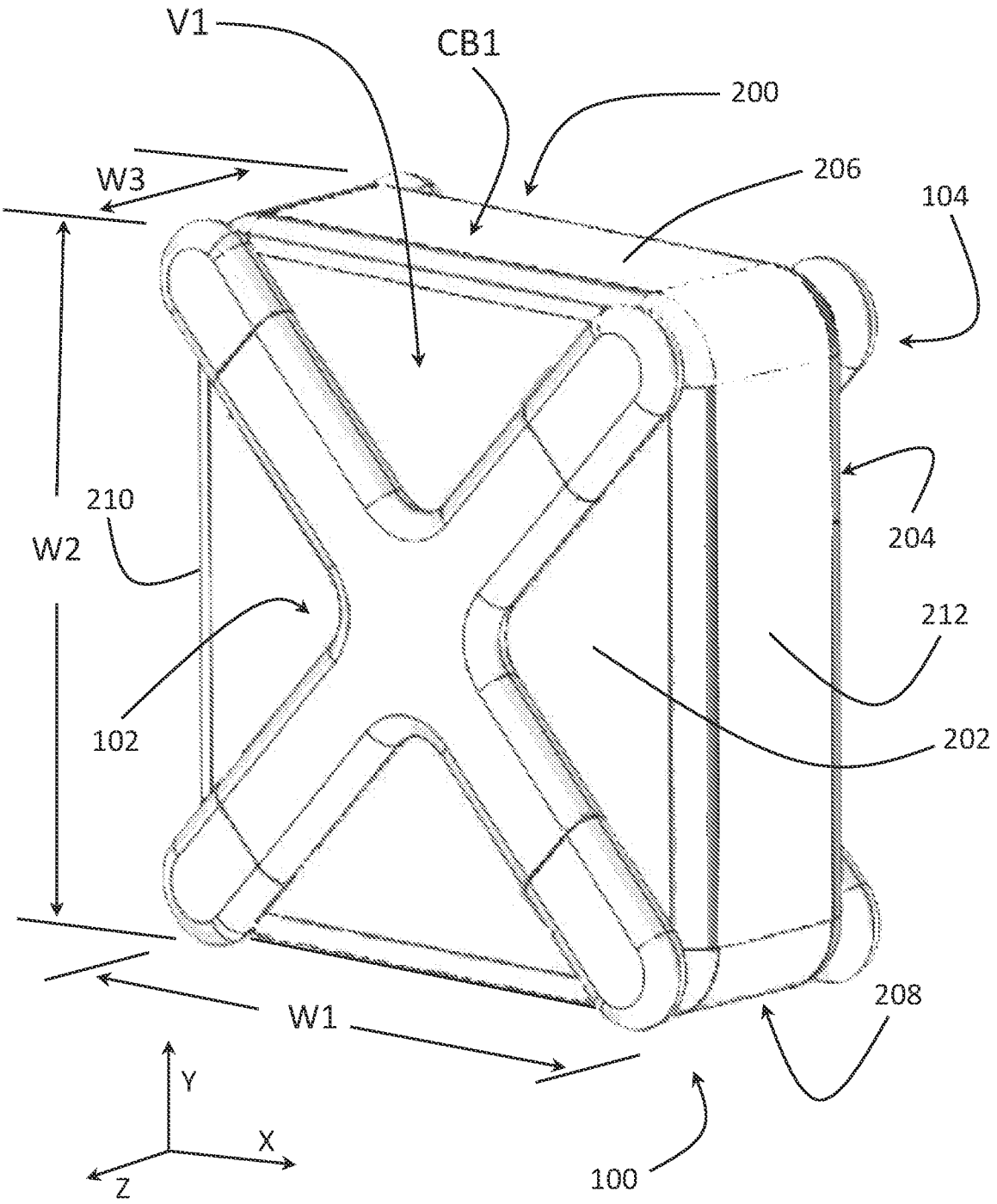

Referring now to FIG. 6, the shell assembly 200 according to exemplary embodiments hereof will be described in further detail. In one embodiment, the shell assembly 200 may generally include a material, a casing, a covering, a shell or other type of structure or form that may generally enclose the internal volume V as described above. In one exemplary embodiment hereof, the shell assembly 200 may generally enclose the internal volume V1 as represented in FIG. 3. This is shown in FIG. 6.

The shell assembly 200 may generally include a front surface 202, a back surface 204, a top surface 206, a bottom surface 208, a left surface 210 and a right surface 212. As shown, the surfaces 202, 204 206, 208, 210, 212 when combined generally form the cuboid CB1 and enclose the internal volume V1.

The shell assembly 200 may include a surface material 214 that may generally form the front surface 202, the back surface 204, the top surface 206, the bottom surface 208, the left surface 210 and the right surface 212. In this way, the surface material 214 may generally form the cuboid form CB1 and enclose the internal volume V1.

The front surface 202, the back surface 204, the top surface 206, the bottom surface 208, the left surface 210, the right surface 212 and any other surfaces may be connected together to form the internal volume V using any attachment methods or means such as stitching, fabric welding, rivets, adhesives, or any other attachment methods or combinations of attachment methods.

In one preferable implementation, the material 214 may stretch and/or expand as required by the expansion of the frame assembly 100. In a preferable implementation, the surface material 214 may stretch and/or expand in two dimensions simultaneously (e.g., along its length and width). It should be noted that the material 214 may have stretch and recovery properties that may be the same or similar along the length of the material 214 compared to the width of the material, or that may have different stretch and recovery properties along the length of the material 214 compared to the width of the material 214.

The term elongation may be used herein to represent the increase in the gage length of the material subject to tensile forces divided by the original gage length. Elongation may be expressed as a percentage of the original gage length.

In one implementation, the material 214 may have an elongation rate of 150% along its length and an elongation rate of 65% along its width. In other implementations, the material 214 may have elongation rates of 70%, 90%, 95%, 110% or 130% along its length, and corresponding elongation rates of 65%, 80%, 65%, 75% or 90% along its width. In one preferred implementation, the material may have an elongation rate of at least 80% along its length and its width. The material 214 may also have other elongation rates as necessary and required by the assembly 10.

It may be preferable for the surface material 214 to be durable and rugged, and have an adequate resistance to mechanical threats such as abrasion, cut, tear and puncture. In one preferable implementation, the material 214 may have a CE rating for abrasion of 4, a CE rating for cut of 5, a CE rating for tear of 4, and a CE rating for puncture of 4. Note that materials 214 with other ratings for each CE category may also be used as adequate.

The material 214 may also include an adequate weight, typically measured as grams per square meter (GSM). In some preferred implementations, the material 214 may have weights of 370 GSM, 380 GSM, 440 GSM, 450 GSM, 500 GSM or 635 GSM. Note that the material 214 with other weights may also be used as adequate.

The material 214 may also include an adequate thickness, typically measured in millimeters (mm). In some preferred implementations, the material 214 may have a thickness of 0.9 mm, 1.0 mm, 1.1 mm, 1.2 mm, 1.3 mm, 1.5 mm, 1.6 mm or other thicknesses as required.

In one preferable implementation, the surface material 214 may include a Kevlar woven Spandex. In another preferred implementation, the material 214 may include an ultrasonic welded neoprene/TPU with Polycarbonate. Note that the material 214 may include a combination of different types of materials. Other types or combinations of types of materials 214 may also be used.

In any event, it may be preferable that as the frame assembly 100 may expand as described above causing the internal volume V1 to expand to an internal volume V2, the surface material 214 may also expand such that the material 214 may continuously enclose the expanding internal volume V (V1 expanding to V2) without failure (e.g., tearing) of the material 214 and without deformation of the form or shape of the internal volume V (e.g., cuboid).

Note that while the above description generally described the shell assembly 200 and the surface material 214 as positioned between the front frame structure 102 and the rear frame structure 104 (e.g., on the back surface 122 of the frame structure 102, and on the front surface 126 of the rear frame structure 104), the shell assembly 200 and the surface material 214 may cover all or portions of the front surface 120 of the front frame structure 102, all or portions of the rear surface 124 of the rear frame structure 104, or any combinations thereof. In this way, the shell 200 and the material 214 may be positioned on the inside of the frame assembly 100, on the outside of the frame assembly 100, or in any combination thereof.

The Protective Assembly

Referring now to FIGS. 7A-7C and 8, the protective assembly 300 according to exemplary embodiments hereof will be described in further detail. In one embodiment, the protective assembly 300 may include at least one surface protective structure 302. In a preferred embodiment, the protective assembly 300 may include a plurality of protective structures 302-1, 302-2, . . . **302-*n* (individually and collectively 302), where n may equal the number of surface protective structures 302**.

In one exemplary embodiment hereof, the surface protective structures 302 may include geometric plates that may be generally positioned on the outer surface of the shell assembly 200. In this way, the plates 302 may provide a protective covering (e.g., armor) to the surface material 214.

Figure 7A:
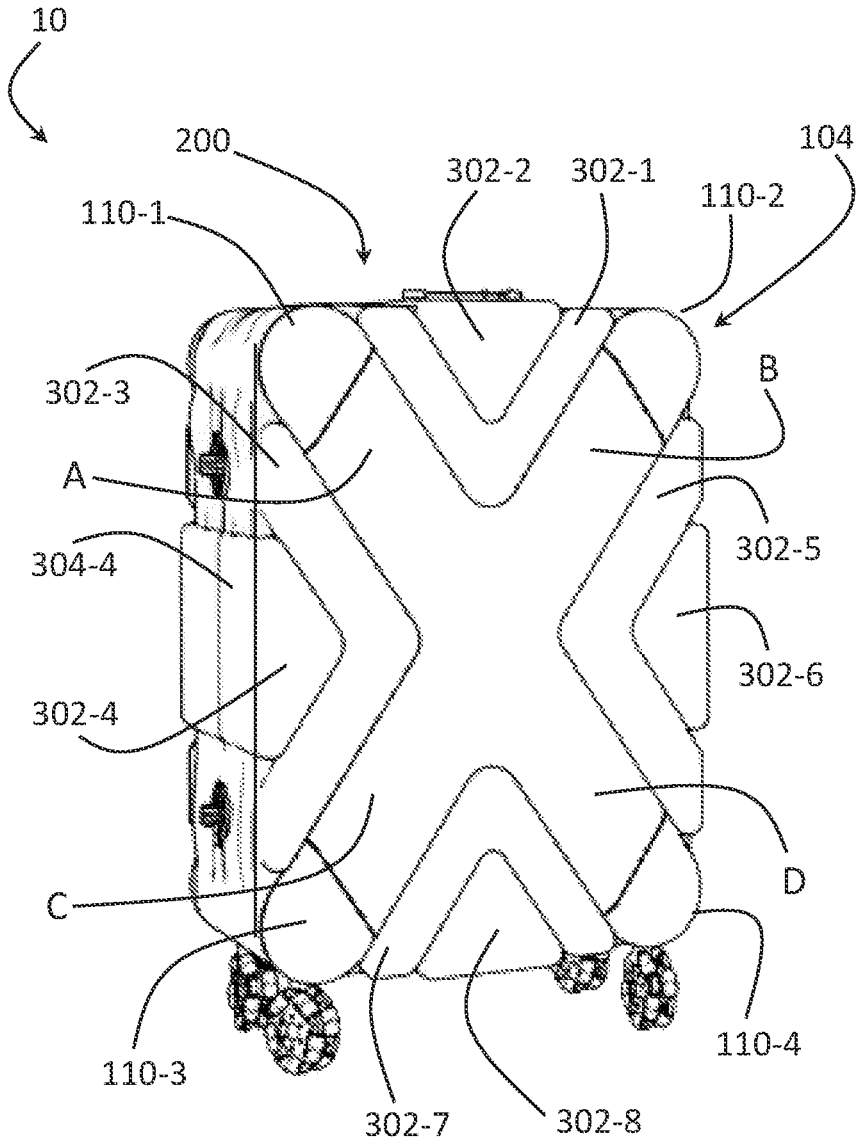
FIGS. 7A-7C show aspects of an expandable container according to at least one exemplary embodiment hereof.
Figure 7B:
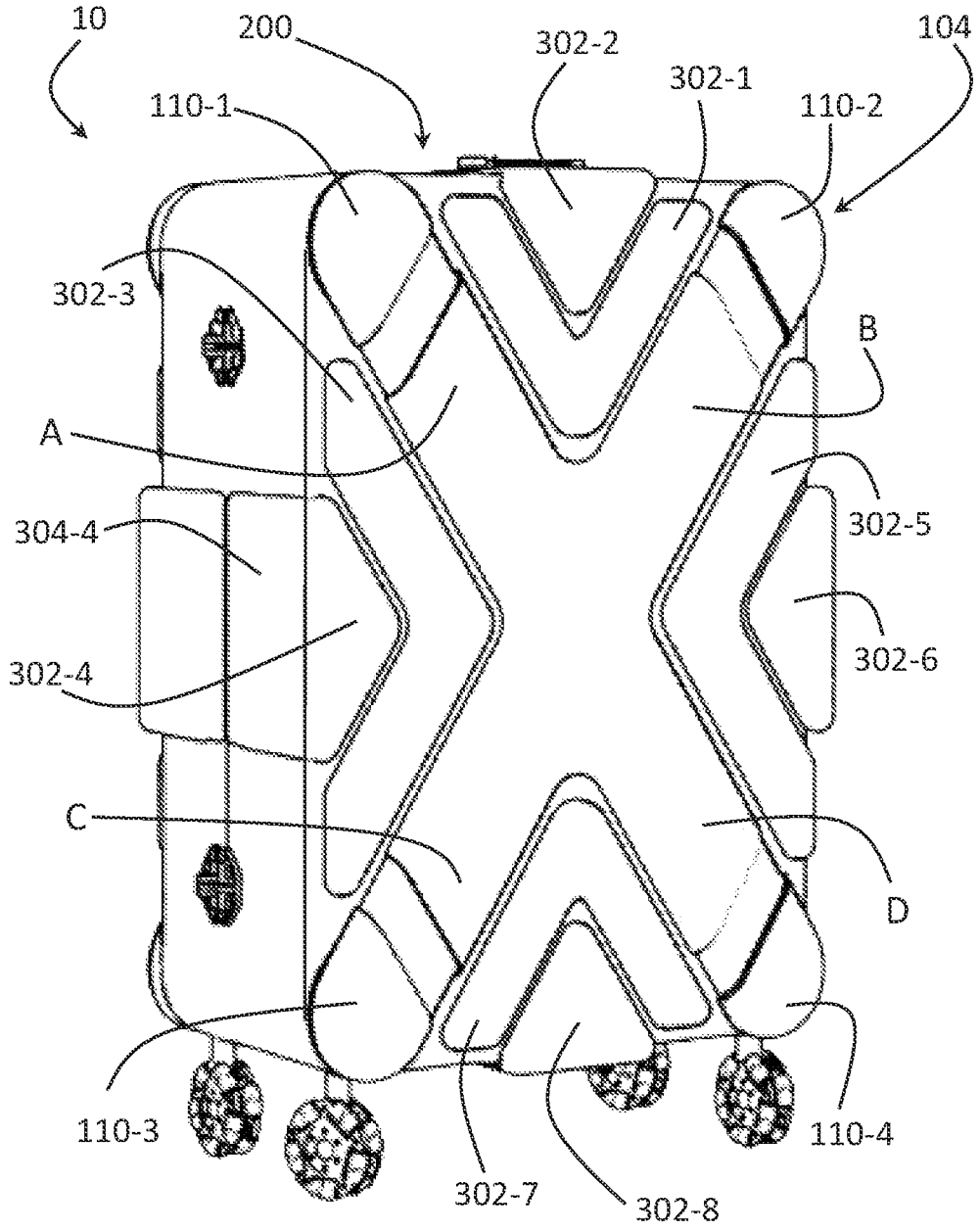
Figure 7C:
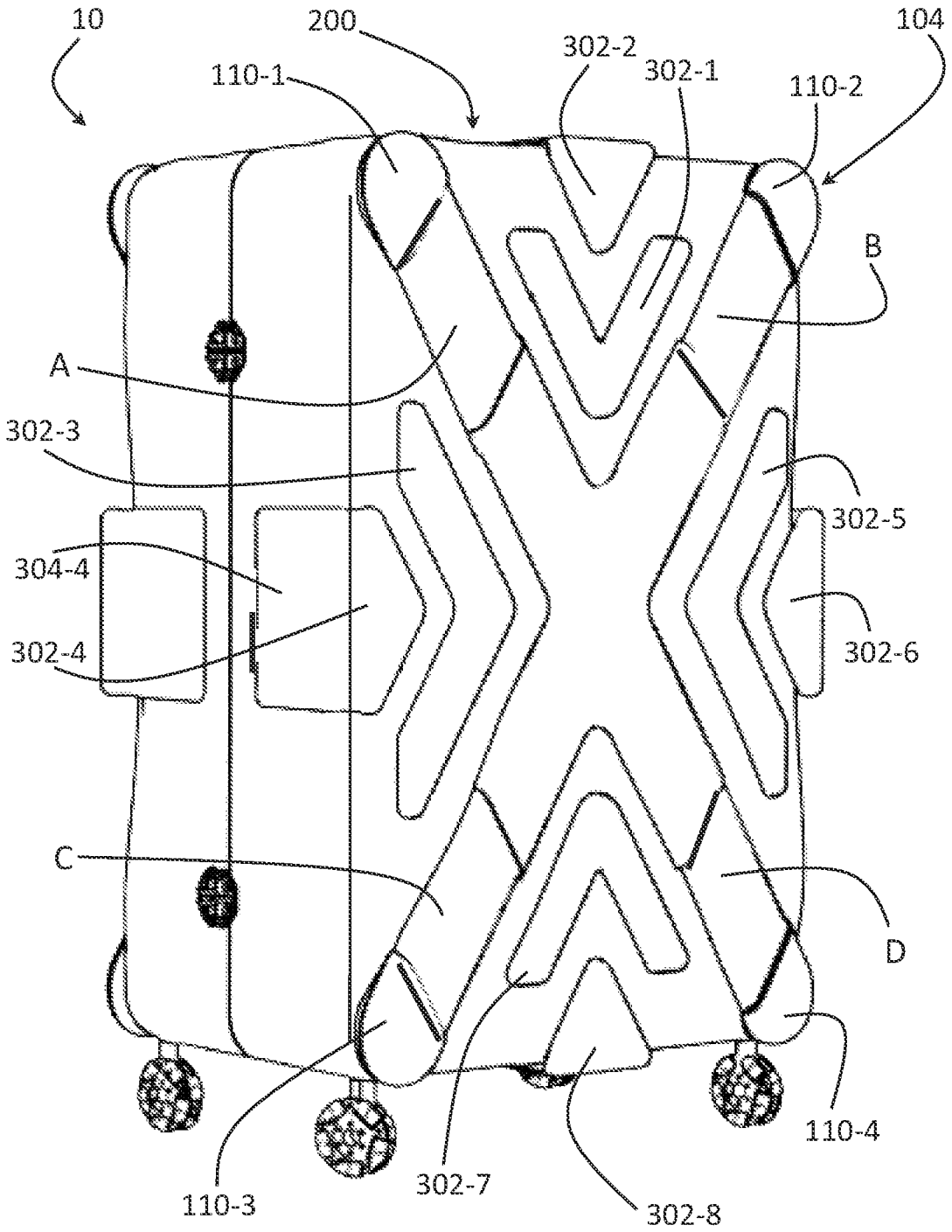

As shown in FIGS. 7A, 7B and 7C, the protective plates 302 may include plates 302 that may be nested geometric shapes. Note that FIG. 7A may represent an assembly 10 with its extension sections 110, 112 in fully retracted positions, FIG. 7B may represent an assembly 10 with its extension sections 110, 112 in generally medium extended positions, and FIG. 7C may represent an assembly 10 with its extension sections 110, 112 in generally maximum extended positions. These positions of extension sections 110, 112 may generally correspond to the Small, Medium and Large settings as shown in the table above. However, this example is meant for demonstration purposes and any position of the extension sections 110, 112 may be used.

In one exemplary embodiment, the plates 302 may include geometric shapes as shown. In one preferred implementation, the plate 302-1 may be a "V" shaped plate 302. It may be preferable that the V shape have equal length sides and an isosceles triangular shaped upper V notch. The plate 302-2 may be a triangular shaped plate 302. It may be preferable that the triangle shape may be isosceles triangle shaped, and that the isosceles triangle shape of the plate 302-2 generally correspond to the isosceles shaped upper V notch in plate 302-1. In this way, the triangular shaped plate 302-2 may generally fit inside the upper "V" notch in the "V" shaped plate 302-1, the sides of the plate 302-2 (e.g., the legs of the isosceles triangle shape) may generally align and correspond with the inner sides of the isosceles triangle shaped V notch of the plate 302-1, and be nested therein. The base of the isosceles triangle shaped plate 302-2 may result facing upwards.

It may be preferable that the size and dimensions of each plate 302-1, 302-2 be such that when the plates 302-1, 302-2 are nested as depicted in FIG. 7A that the combined plates 302-1, 302-2 form a combined triangular shape (e.g., preferably isosceles triangle shape). This may result in a combined triangular shape with a generally even top.

Note that in this example, the front frame support 102 may be a cross support 106. Given this, the top of the cross support 106 may include a V shaped notch that may be formed by the arms A and B, and each arm's respective extension sections 110-1, 110-2. It may be preferable that the upper V shaped notch in the cross support 106 generally correspond in size and shape to the isosceles triangle shape of the combined triangular shape of nested plates 302-1, 302-2. In this way, the sides of the plate 302-1 (e.g., the legs of the isosceles triangle shape of the combined plates 302-1, 302-2) may generally align and correspond with the inner sides of the isosceles triangle shaped V notch of the cross support 106. This may result in a combined nested shape with a generally even top.

The example of the above described configuration of the upper plates 302-1, 302-2 nested together and with the upper arms A, B with respective extension sections 110-1, 110-2 can be expanded as shown in FIG. 7A for the surface plates 302-3, 302-4 configured with arms A, C and respective extension sections 110-1, 110-3, for the surface plates 302-5, 302-6 configured with arms B, D and respective extension sections 110-2, 110-4, and for the surface plates 302-7, 302-8 configured with arms C, D and respective extension sections 110-3, 110-4.

In the non-expanded configuration of FIG. 7A (e.g., with extension sections 110 fully retracted), it may be preferable that the plates 302 nest within each other and within the arms A-D with only a small amount of space between the adjacent and corresponding surfaces. In one exemplary implementation, the space between the adjacent surfaces of the nested plates 302 and the arms A-D may be 1.0 mm, 3.0 mm, 5.0 mm, 7.0 mm, or 1.0 cm. However, any other spacing between the adjacent surfaces may also be used. In addition, some or all of the adjacent surfaces may abut against one another.

As can be seen, the surface plates 302 configured with the front cross support 106 and respective extension sections 110 may result in a generally armored front surface of the shell assembly 200.

In one exemplary embodiment hereof, the surface plates 302 may also include corresponding side sections 304. In one exemplary implementation, the surface plates 302-2, 302-4, 302-6 and 302-8 may include corresponding side sections 304-2, 304-4, 304-6 and 304-8 that may generally extend from the outer edge of each surface plate 302-2, 302-4, 302-6 and 302-8 respectively to the top 206, left side 210, right side 212 and the bottom 208 of the shell assembly 200. Note however that any plates 302 may include side sections 304.

Using the surface plate 302-4 and its corresponding side section 304-4 as an example (as best seen in FIG. 7A), it can be seen that the side section 304-4 may generally extend perpendicularly from the front of the plate 302-4 to over the side 210 of the shell assembly 200. The width of the side section 304-4 may generally correspond to the width of the outer edge of the plate 302-4, but this may not be required. In addition, the side section 304-4 may generally extend from the outer edge of the plate 302-2 to the center of the side 210 of the shell 200. However, the side section 304-4 may extend to any depth or position on the side 210 of the shell 200. In this way, the side section 304-4 may provide additional protection to the side 210 of the shell 200 in the area that it may cover. This example may be extended to any plates 302, and any plates or combinations of plates 302 may include side sections 304.

While not depicted in the figures, the rear support frame 104 may also be a cross support 108 with arms E-H and respective extension sections 112-1, 112-2, 112-3, 112-4, and may also include corresponding surface plates 302. It is understood by a person of ordinary skill in the art that the rear cross support 108 may include protective surface plates 302 and that all of the details described herein pertaining to the front cross support 106 and its associated front plates 302 may also apply to the rear cross support 108 and its corresponding associated rear plates 302.

The surface material 214 may extend underneath each surface plate 302 and the surface plates 302 may be attached to the outer surface of the surface material 214 using stitching, adhesives, fabric welding, attachment mechanisms such as snaps, grommets, latches or any other type or combinations of types of attachment means.

In addition, the surface material 214 may be attached to the edges of the surface plates 302 to generally extend between the surface plates 302. In this way, the surface material 214 may not necessarily extend underneath the entire under surface of the plates 302. It is understood that the surface material 214 may extend under some or all of the plates 302, may not extend under some or all of the plates 302, or may extend in any combination thereof.

According to exemplary embodiments hereof, given this configuration, as the expandable frames 102, 104 (e.g., cross supports 106, 108) may expand (e.g., by extending each corresponding extension section 110, 112), it can be understood that the surface material 214 may expand to accommodate the expanding interior volume V (as described above) and that the protective plates 302 may shift in relation to the expanding surface material 214. In one exemplary example as shown in FIG. 7B, the extension sections 110, 112 may be extended to a generally medium expanded position, the surface material 214 may expand to accommodate the extensions, and the plates 302 may generally shift outward with the expansion of the surface material 214.

It can be seen that the gaps or spacings between the adjacent edges of the corresponding plates 302, arms the A-D, E-H and extension sections 110, 112 may increase. It may be preferable that the gaps or spacings increase evenly and proportionally with respect to the expanding structure 10 and with the expanding surface material 214, but this may not be required. This is shown in FIG. 7B.

As the assembly 10 and surface material 214 continues to expand (e.g., the extension sections 110, 112 continue to extend further outwards from the arms A-D, E-H), the surface panels 302 may continue to shift outwards relative to the expanding structure 10 and material 214. In this way, the gaps or spacings between the adjacent edges of the corresponding plates 302, arms the A-D, E-H and extension sections 110, 112 may continue to grow and increase. It may be preferable that the gaps or spacings continue to increase evenly and proportionally with respect to the expanding structure 10 and with the expanding surface material 214, but this may not be required. This is shown in FIG. 7C.

Note that FIG. 7C also shows the connecting structures 118 expanding to generally increase the width W3 of the assembly 10 and the internal volume V. The shell assembly 200, including the surface material 214, may also expand along the z-axis to accommodate this expansion while holding the form (e.g., cuboid) of the shell 200 and the internal volume V within.

It can be seen that in the expanded configurations of FIGS. 7B and 7C that some or all of the surface plates 302 may be generally evenly spaced from the cross support 106 to the edges of the shell 200, and that the plates 302 may provide protection to the shell 200 and the surface material 214. In this way, the protective plates 302 may also provide protection, support (e.g., lateral support) and reinforcement to the shape of the shell 200 and the surface material 214, helping to ensure the mechanical and structural integrity of the assembly 10. Note however that some or all of the plates 302 may not be evenly spaced during and upon expansion of the assembly 10. In addition, some plates 302 may not shift during the expansion of the assembly.

It may be preferable that the plates 302 comprise a material that may be rugged and generally puncture-proof such as metal (e.g., aluminum, steel or other types of metal), plastic (e.g., Polycarbonate, ABS or other types of plastics), composite materials or any other type of material that may be adequately rugged. It is clear that the scope of the assembly 10 and the plates 302 are not limited in scope in any way by the types of material the plates 302 may comprise.

In addition, the dimensions of the plates 302 may be such that the plates 302 may provide adequate protection to the shell 200 and the material 214. Different plates 302 may have different dimensions. For example, some of the plates 302 may be larger plates 302 and may have widths and/or lengths of several inches (e.g., 2 inches, 3 inches, 6 inches, 8 inches, 10 inches 12 inches, or other widths and/or lengths). Other plates 302 may have smaller widths and/or lengths. Also, the thickness of the plates 302 may be adequate to provide the protection to the shell 200 and the surface material 214 as described (e.g., 0.25 inch, 0.5 inch, 0.75 inch, 1.0 inch, 1.25 inch, 1.5 inch or other thicknesses). The thickness of the plates 302 does not necessarily need to be uniform across all of the plates 302 and some plates 302 may have different thicknesses compared to other plates 302.

It is clear to a person of ordinary skill in the art that the above embodiments and examples are meant for demonstration and conceptual purposes, and that one or more of the protective plates 302 may include other types of shapes and forms that may be nested. For example, the plates 302 may be nested U shaped plates, nested crescent shaped plates 302, or any other types of nested shapes or forms, or any combinations of types of nested shapes and forms. In addition, one or more plates 302 of one type of shape or form may be nested with other plates 302 of different shapes or forms. It is understood that the plates may take any shape or form and that the shape or forms do not limit the scope of the plates 302 or of the assembly 10 in any way.

In addition, while the examples described above in relation to FIGS. 7A-7C show a plurality of plates 302, with some of the plates 302 nested within other plates 302 or within the frame structures 102, 104, some or all of the plates 302 may not be nested within other plates 302 or within the frame structures 102, 104. In this case, one or more plates 302 may be aligned side-by-side or in other positions and orientations with respect to adjacent plates 302 and the frame structures 102, 104. For example, a plate 302 may be a rectangular shaped plate 302 and be configured next to, parallel and generally aligned with another rectangular shaped plate 302. In this example, the side-by-side plates 302 may be in close proximity to one another (e.g., 0.25 inch, 0.5 inch) when the assembly 10 may be in a generally retracted configuration, and the side-by-side plates 302 may then shift with the expansion of the assembly 10 such that the spacing between the plates may grow and expand as assembly 10 expands and the plates 302 shift. It is clear and understood by a person of ordinary skill in the art that this example is meant for demonstration and conceptual purposes and that one or more of the plates 302 may be non-nested plates 302, and that any of the plates 302 may be of any shape or form, or any combination of shapes and forms (e.g., square shaped, trapezoidal, octagonal, and/or any other type of shape or form including abstract shapes and forms).

It is also clear to a person of ordinary skill in the art, upon reading this specification, that one or more of the protective plates 302 may be nested with one or more other protective plates 302, or with the frame structures 102, 104, and that one or more of the protective plates 302 may not be nested within other plates 302 or with the frame structures 102, 104. It is understood that any of the plates 302 may be of shape or form of nested or non-nested shapes or forms, or any combinations thereof. It is also appreciated that the assembly 10 may include one or more, or any number of protective plates 302.

Figure 8:
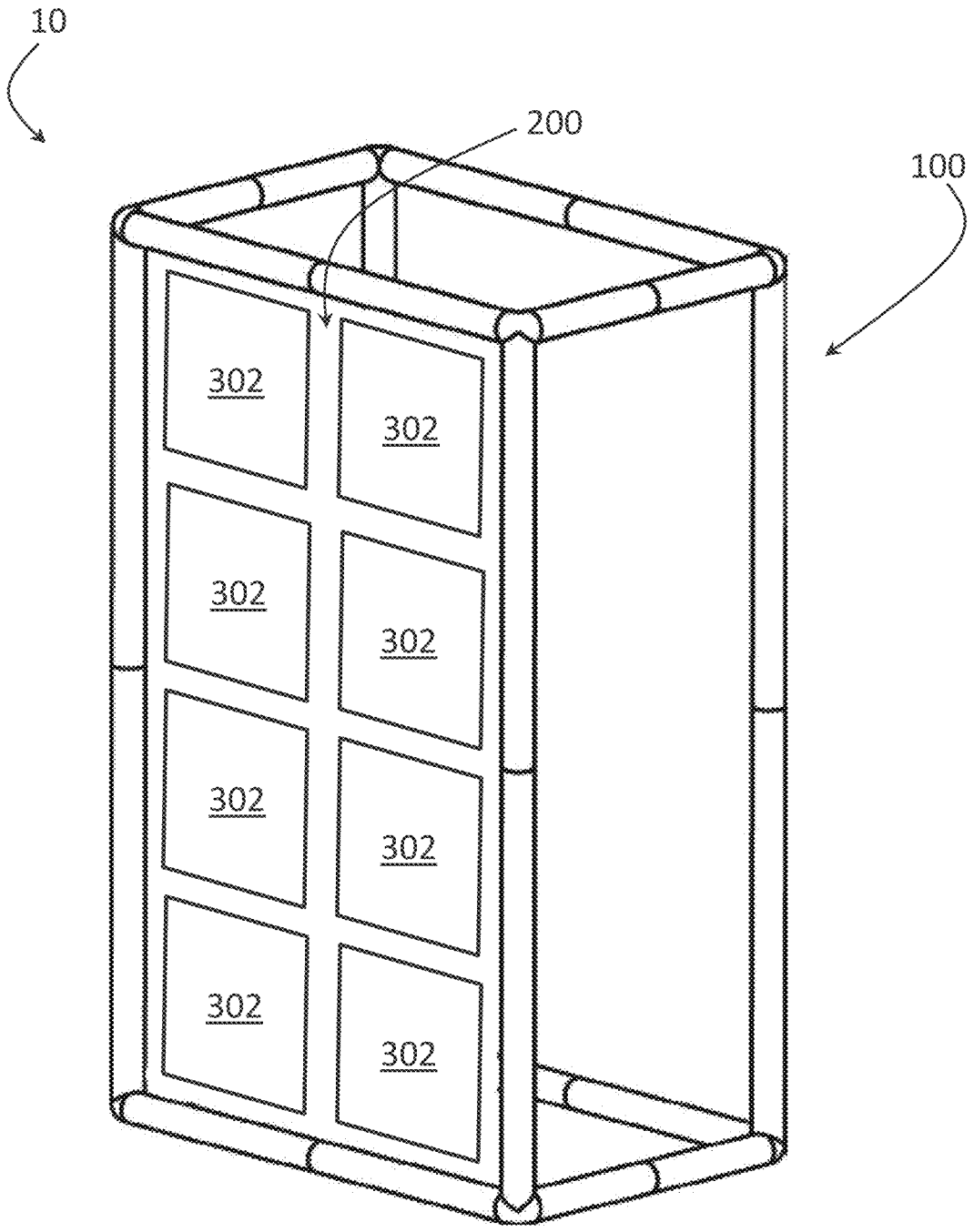
FIG. 8 shows aspects of an expandable container according to exemplary embodiments hereof.

As described above, the frame assembly 100 may be of different shapes and forms other than the cross-shaped form described above. Using the example depicted in FIG. 2, it can be seen that the frame assembly may be formed as a generally rectangular structure. As shown in FIG. 8, the generally rectangular frame assembly 100-3 may include a shell assembly 200 and protective plates 302 on its surfaces. It is understood that all of the aspects and details described in other sections of the frame assembly 100, the shell assembly 200 and the protective assembly 300, including the expansion of the frame assembly 100 and the expansion of the shell assembly 200, and the shifting of the protective plates 302, also pertain and directly apply to the generally rectangular frame assembly 100-3 of FIG. 8. It is also understood that the generally rectangular frame assembly 100-3 of FIG. 8 is meant for demonstration and conceptual purposes and the frame assembly 100-3 may take any form or shape, and that the corresponding shell assemblies 200 and corresponding protective assemblies 300 may also take on any form or shape as required by the form and shape of the frame assembly 100. The scope of the assembly 10 is not limited in any way by the shape and form of the frame assembly 100, the shell assembly 200 or the protective assembly 300.

It is understood by a person of ordinary skill in the art that the assembly 10 may be opened such that items may be inserted into and removed from the internal volume V of the assembly 10. In one example, the front and rear frame sections 102, 104 may be connected on one side (e.g., the left side) using hinge mechanisms such that the frame sections 102, 104 may be rotated about the axis of the hinges to open the assembly 10. The frame assemblies may also include locking mechanisms on one or more sides to secure the frame sections 102, 104 together when the assembly 10 may be closed. It may be preferable that the connecting sections 118 have the ability to separate to allow the frame sections to separate from one another during the opening and closing of the assembly 10. It may also be preferable that the shell assembly 200 include a seam that may allow the shell assembly 200 to separate into at least two portions to allow the frame sections 102, 104 to be separated to open and close the assembly 10. The assembly 10 may be opened on the top, the bottom, the front, the back, the left side, the right side or in any combinations thereof. In addition, the top, the bottom, the front, the back, the left side, the right side or any other side may include panels that may open to allow items to be inserted into the assembly 10. The top, the bottom, the front, the back, the left side, the right side or any other side may also open by means of a hinge mechanism. It is understood by a person of ordinary skill in the art that the assembly 10 may be opened by a wide variety of methods and that the methods by which the assembly 10 may be opened do not limit the scope of the assembly 10 in any way.

Where a process is described herein, those of ordinary skill in the art will appreciate that the process may operate without any user intervention. In another embodiment, the process includes some human intervention (e.g., a step is performed by or with the assistance of a human).

As used herein, including in the claims, the phrase "at least some" means "one or more," and includes the case of only one. Thus, e.g., the phrase "at least some ABCs" means "one or more ABCs", and includes the case of only one ABC.

As used herein, including in the claims, term "at least one" should be understood as meaning "one or more", and therefore includes both embodiments that include one or multiple components. Furthermore, dependent claims that refer to independent claims that describe features with "at least one" have the same meaning, both when the feature is referred to as "the" and "the at least one".

As used in this description, the term "portion" means some or all. So, for example, "A portion of X" may include some of "X" or all of "X". In the context of a conversation, the term "portion" means some or all of the conversation.

As used herein, including in the claims, the phrase "using" means "using at least," and is not exclusive. Thus, e.g., the phrase "using X" means "using at least X." Unless specifically stated by use of the word "only", the phrase "using X" does not mean "using only X."

As used herein, including in the claims, the phrase "based on" means "based in part on" or "based, at least in part, on," and is not exclusive. Thus, e.g., the phrase "based on factor X" means "based in part on factor X" or "based, at least in part, on factor X." Unless specifically stated by use of the word "only", the phrase "based on X" does not mean "based only on X."

In general, as used herein, including in the claims, unless the word "only" is specifically used in a phrase, it should not be read into that phrase.

As used herein, including in the claims, the phrase "distinct" means "at least partially distinct." Unless specifically stated, distinct does not mean fully distinct. Thus, e.g., the phrase, "X is distinct from Y" means that "X is at least partially distinct from Y," and does not mean that "X is fully distinct from Y." Thus, as used herein, including in the claims, the phrase "X is distinct from Y" means that X differs from Y in at least some way.

It should be appreciated that the words "first," "second," and so on, in the description and claims, are used to distinguish or identify, and not to show a serial or numerical limitation. Similarly, letter labels (e.g., "(A)", "(B)", "(C)", and so on, or "(a)", "(b)", and so on) and/or numbers (e.g., "(i)", "(ii)", and so on) are used to assist in readability and to help distinguish and/or identify, and are not intended to be otherwise limiting or to impose or imply any serial or numerical limitations or orderings. Similarly, words such as "particular," "specific," "certain," and "given," in the description and claims, if used, are to distinguish or identify, and are not intended to be otherwise limiting.

As used herein, including in the claims, the terms "multiple" and "plurality" mean "two or more," and include the case of "two." Thus, e.g., the phrase "multiple ABCs," means "two or more ABCs," and includes "two ABCs." Similarly, e.g., the phrase "multiple PQRs," means "two or more PQRs," and includes "two PQRs."

The present invention also covers the exact terms, features, values and ranges, etc. in case these terms, features, values and ranges etc. are used in conjunction with terms such as about, around, generally, substantially, essentially, at least etc. (i.e., "about 3" or "approximately 3" shall also cover exactly 3 or "substantially constant" shall also cover exactly constant).

As used herein, including in the claims, singular forms of terms are to be construed as also including the plural form and vice versa, unless the context indicates otherwise. Thus, it should be noted that as used herein, the singular forms "a," "an," and "the" include plural references unless the context clearly dictates otherwise.

Throughout the description and claims, the terms "comprise", "including", "having", and "contain" and their variations should be understood as meaning "including but not limited to", and are not intended to exclude other components unless specifically so stated.

It will be appreciated that variations to the embodiments of the invention can be made while still falling within the scope of the invention. Alternative features serving the same, equivalent or similar purpose can replace features disclosed in the specification, unless stated otherwise. Thus, unless stated otherwise, each feature disclosed represents one example of a generic series of equivalent or similar features.

The present invention also covers the exact terms, features, values and ranges, etc. in case these terms, features, values and ranges etc. are used in conjunction with terms such as about, around, generally, substantially, essentially, at least etc. (i.e., "about 3" shall also cover exactly 3 or "substantially constant" shall also cover exactly constant).

Use of exemplary language, such as "for instance", "such as", "for example" ("e.g.,") and the like, is merely intended to better illustrate the invention and does not indicate a limitation on the scope of the invention unless specifically so claimed.

While the invention has been described in connection with what is presently considered to be the most practical and preferred embodiments, it is to be understood that the invention is not to be limited to the disclosed embodiment, but on the contrary, is intended to cover various modifications and equivalent arrangements included within the spirit and scope of the appended claims.

What is claimed is:

1. An expandable container for carrying at least one item, the expandable container comprising:

a first cross support comprising a plurality of first arm sections extending radially outward from a first central base, each one of the plurality of first arm sections including a corresponding angle that is fixed with respect to the first central base, each one of the plurality of first arm sections including at least one first extendable section;

a second cross support comprising a plurality of second arm sections extending radially outward from a second central base, each one of the plurality of second arm sections including a corresponding angle that is fixed with respect to the second central base, each one of the plurality of second arm sections including at least one second extendable section, the second cross support opposing the first cross support and defining a first expandable volume therebetween;

at least one connecting section extending between at least one of the plurality of first extendable sections and at least one of the plurality of second extendable sections; and an expandable shell configured with the first expandable volume and defining a second expandable volume adapted to contain the at least one item;

wherein the first volume and the second volume are adapted to be simultaneously increased by extending at least one of the at least one first extendable sections, and/or by extending at least one of the at least one second extendable sections.

2. The expandable container of claim 1 wherein the plurality of first arm sections includes a total of four first arm sections, and the plurality of second arm sections includes a total of four second arm sections.

3. The expandable container of claim 2 wherein the total of four first arm sections includes a first first arm section, a second first arm section, a third first arm section and a fourth first arm section, and the total of four second arm sections includes a first second arm section, a second second arm section, a third second arm section and a fourth second arm section, and wherein the first first arm section and the second first arm section are opposing, the second first arm section and the second second arm section are opposing, the third first arm section and the third second arm section are opposing, and the fourth first arm section and the fourth second arm section are opposing.

4. The expandable container of claim 3 wherein the at least one connecting section includes a first connecting section extending between the first first arm section and the first second arm section, a second connecting section extending between the second first arm section and the second second arm section, a third connecting section extending between the third first arm section and the third second arm section, and a fourth connecting section extending between the fourth first arm section and the fourth second arm section.

5. The expandable container of claim 1 wherein the at least one first extendable section is located at a distal end of the each one of the plurality of first arm sections.

6. The expandable container of claim 1 wherein the at least one second extendable section is located at a distal end of the each one of the plurality of second arm sections.

7. The expandable container of claim 1 wherein the at least one connecting section extends between a distal end of the at least one of the plurality of first extendable section and a distal end of the at least one of the plurality of second extendable sections.

8. The expandable container of claim 1 wherein the expandable shell comprises an expandable material.

9. The expandable container of claim 1 further comprising:

at least one plate configured with the expandable outer shell.

10. The expandable container of claim 9 wherein the plate is adapted to shift as the volume is increased.

11. The expandable container of claim 9 wherein the at least one plate includes at least two nested plates.

12. The expandable container of claim 11 wherein at least one of the at least two nested plates includes a V-shaped plate.

13. The expandable container of claim 11 wherein at least one of the at least two nested plates includes a triangular shaped plate.

14. The expandable container of claim 1 wherein the expandable container is luggage.

* * * * *